United States Patent [19]

Off

[11] 4,349,920

[45] Sep. 21, 1982

[54] POCKET CONSTRUCTION

[75] Inventor: Joseph W. A. Off, Irving, Tex.

[73] Assignee: Haggar Company, Dallas, Tex.

[21] Appl. No.: 168,503

[22] Filed: Jul. 14, 1980

Related U.S. Application Data

[60] Division of Ser. No. 948,016, Oct. 2, 1978, Pat. No. 4,263,678, which is a continuation-in-part of Ser. No. 905,054, May 11, 1978, Pat. No. 4,156,293, which is a continuation of Ser. No. 819,843, Jul. 28, 1977, abandoned.

[51] Int. Cl.[3] ..... A41D 27/20

[52] U.S. Cl. ..... 2/247

[58] Field of Search ..... 2/247, 248, 253, 243 A, 2/160; 428/261

[56] References Cited

U.S. PATENT DOCUMENTS

| | | | |
|---|---|---|---|
| 1,832,214 | 11/1931 | Jenkins | 2/247 |
| 2,011,958 | 8/1935 | Vizard | 36/17 R |
| 2,282,214 | 5/1942 | Rosenstein | 239/75 |
| 2,282,545 | 5/1942 | Rosenstein | 2/247 |
| 2,403,694 | 7/1946 | Vizard | 36/78 |
| 3,137,865 | 6/1964 | Evans | 2/247 |
| 3,168,749 | 2/1965 | Cala | 2/243 R |
| 3,215,552 | 11/1965 | Halcomb et al. | 428/261 X |
| 3,451,065 | 6/1969 | Augustin | 2/247 |
| 3,540,975 | 11/1970 | Wright | 428/194 |
| 3,560,292 | 2/1971 | Butter | 156/229 |
| 3,564,615 | 2/1971 | Jacobsen | 2/247 |
| 3,719,955 | 3/1973 | Hrubecky | 2/243 R |
| 3,725,959 | 4/1973 | Cruden | 2/243 R |
| 3,794,554 | 2/1974 | Caring | 428/43 |
| 3,840,901 | 10/1974 | Eyster | 2/247 |
| 3,861,974 | 1/1975 | Trombly | 156/200 |
| 3,881,041 | 4/1975 | Glienke | 428/40 |

*Primary Examiner*—Peter P. Nerbun

*Attorney, Agent, or Firm*—Richards, Harris & Medlock

[57] ABSTRACT

In a method of constructing pockets, a pocket blank is preferably folded first along both longitudinal edges, and then transversely so that the folded edges are inside the two resultant pocket panels. The inner pocket panel is adhesively secured to the inside of a garment wherein a pocket is desired. Following formation of a slit of predetermined shape in the adhesive connection between the garment and inner pocket panel, the flaps formed thereby are folded back and adhesively secured to produce a pocket slot. Alternatively, the slot can be formed directly by cutting or punching a rectangular opening through the garment and inner pocket panel. In accordance with the preferred construction, a pocket welt is then adhesively secured across the bottom of the slot. A reinforcing stitch is preferably added through the welt and the folded back bottom edge of the slot. If desired, another welt or a pocket flap extending through the slot can be adhesively secured across the top of the slot. A facing strip can then be placed over the welt(s), flap and/or remainder of the slot, if desired. Stitched tacks are provided at both ends of the slot through the garment, inner pocket panel, and desired pocket components. The upper section of the outer pocket panel is then closed and adhesively secured at least to the upper end and remaining edge sections of the inner pocket panel to complete construction of the pocket.

31 Claims, 27 Drawing Figures

POCKET CONSTRUCTION

CROSS-REFERENCE TO RELATED APPLICATIONS

This is a division of application Ser. No. 948,016 filed Oct. 2, 1978 now U.S. Pat. No. 4,263,678 which is a continuation-in-part of co-pending application Ser. No. 905,054 filed May 11, 1978, now U.S. Pat. No. 4,156,293 which is a continuation of application Ser. No. 819,843 filed July 28, 1977, abandoned.

BACKGROUND AND SUMMARY OF THE INVENTION

The present invention relates generally to a method of making pockets, and more particularly to a method of making pockets in any garment requiring pockets.

In the manufacture of garments, pockets are provided chiefly as a convenient means for carrying useful articles. Such useful items may include, for example, currency, change, keys, a wallet, a handkerchief and so forth. The pockets are integrated into the garment and take the general form of a pouch open at one end to permit easy access to the contents.

Two basic types of pocket construction are used. In the patch-type pocket, a layer of patch of material is attached directly to the outside surface of the garment. The patch pocket is usually sewn only at the side and bottom edges so that articles can be received between the garment and pocket layers through the unsecured upper end. Patch pockets are thus easily constructed and attached to the garment, and are utilized most popularly in garments having less formal or leisure applications. In contrast to the patch-type pocket, the standard pocket is positioned on the inside of the garment. A slot in the garment permits access to the standard pocket. Consequently a standard pocket occupies a hidden, protected location in the garment, which therefore presents a much neater, finished appearance. However, construction of the standard pocket requires numerous manual operations including material cutting, positioning, sewing and trimming. These manual operations are time consuming and therefore expensive in terms of both labor and material expenditure.

The present invention comprises a method of constructing pockets in garments which overcomes the foregoing and other problems long since associated with the prior art. In accordance with the broader aspects of the invention, a length of pocket material is folded to provide two pocket panels interconnected by a fold with the obverse sides thereof facing inwardly. Preferably, portions of both longitudinal edges of the folded pocket are adhesively secured before securing the inner pocket panel to the inside surface of the garment. A pocket slot is then formed in the garment and selected components of the pocket are then assembled before adhesively securing the remaining peripheries of the pocket panels. By this method, garment pockets are constructed from the interior of the garment with a minimum number of manual operations.

In accordance with more specific aspects of the invention, a length of material defining a pocket blank is first provided. Preferably, three areas of fusible adhesive material are located on the same side of the pocket blank; along portions of both longitudinal edges, and transversely in a strip near one end thereof. The pocket blank is first folded along the longitudinal edges, and later transversely so that each folded edge portion having fusible adhesive material thereon is adjacent the remaining portion of the same folded edge.

Alternatively, the areas of fusible adhesive material can be provided on opposite sides of the pocket blank; along portions of both longitudinal edges on the observe side, and transversely in a strip near one end of the reverse side. Such a pocket blank is simply folded transversely in order to overlap each adhesive edge portion.

In accordance with the preferred construction, the fusible adhesive material in the vicinity of the fold interconnecting the inner and outer pocket blank panels is then activated to adhesively secure the bottom section of the pocket. Preferably, activation of the fusible adhesive material is accomplished by engaging the pocket blank with a heated press, ultrasonic means, or a radiant source capable of converting the adhesive from solid to plastic state.

After the pocket blank panels have been folded and adhesively secured in part, the inner pocket panel is adhesively secured to the inside surface of the garment by activating the transverse strip of fusible adhesive material. A slit, from which the pocket opening is constructed, is then formed through the adhesive connection between the garment and inner pocket panel. Alternatively, the pocket opening can be formed directly by cutting or punching a rectangular slot through the garment and inner pocket panel.

Depending upon the particular type of pocket desired, any of several welt, flap and facing strip combinations can be adhesively secured across or within the pocket opening. If desired, a reinforcing stitch can be provided through the welt and folded back bottom edge of the opening. Stitched bar tacks are then provided at each end of the pocket opening to mechanically interconnect the garment, inner pocket panel and selected pocket components. If desired, an adhesive connection can be employed in place of the stitched bar tacks. At this juncture, the internal assembly of the pocket can be inspected before closing and adhesively securing the remaining section of the outer pocket panel to the inner pocket panel to complete the pocket construction.

DESCRIPTION OF THE DRAWINGS

A more complete understanding of the invention may be had by reference to the following Detailed Description when taken in conjunction with the accompanying Drawings, wherein.

DETAILED DESCRIPTION OF THE INVENTION

Figure 1:
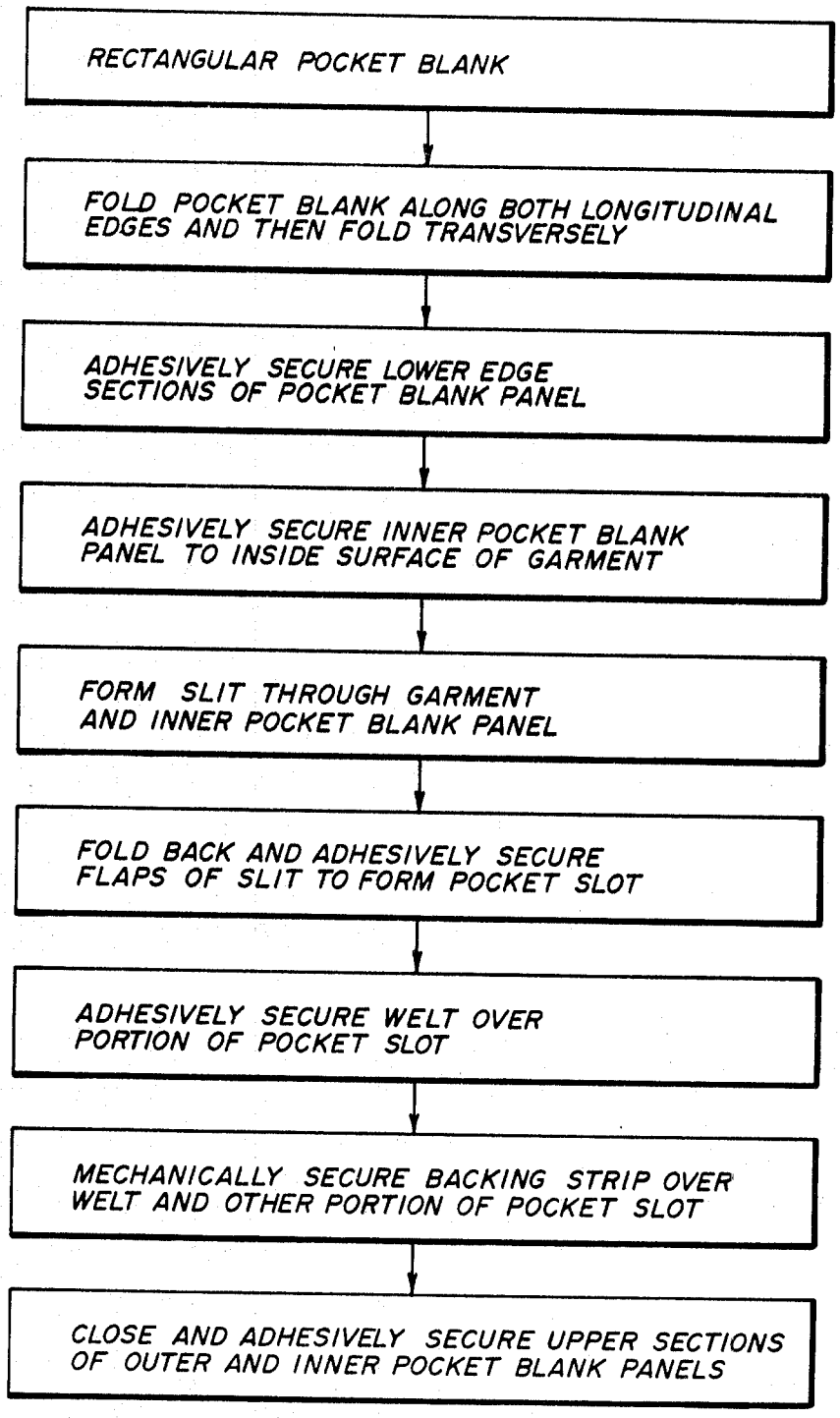
FIG. 1 is a block diagram illustrating a method of constructing pockets for garments incorporating the invention.

Referring now to the Drawings, and particularly to FIG. 1 thereof, there is illustrated a method of constructing pockets incorporating the invention. The method includes the utilization of fusible adhesive materials to eliminate many heretofore required time consuming and costly manual operations in pocket construction. The method of the invention can be used in the manufacture of any garment utilizing pockets. Use of the method results in a strong, durable pocket contruction of pleasing appearance.

Figure 2:
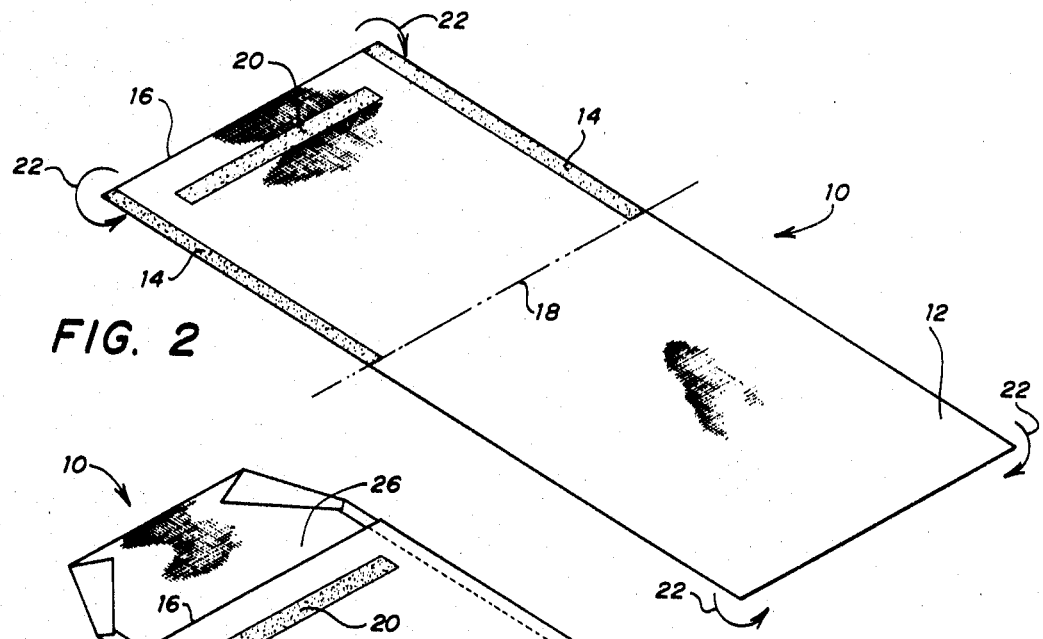
FIG. 2 is an illustration of a length of pocket material useful in forming a pocket blank.

Referring particularly to FIG. 2, there is shown a pocket blank 10 useful in the practice of the invention. Pocket blank 10 is depicted in a flat, unfolded initial condition with the reverse side up. Pocket blank 10 is formed from a length of pocket material 12 having sufficient overall dimensions to allow construction of a pocket having predetermined depth and width. Material 12 can comprise any natural or synthetic cloth material suitable for use in pocket construction. It will be understood that the exact composition of pocket material 12 is not critical to the practice of the invention.

In particular, pocket blank 10 comprises a rectangular piece of pocket material 12 having adhesive areas 14 located adjacent part of both longitudinal edges of the reverse side thereof. Adhesive areas 14 can be formed by attaching a thin layer of fusible adhesive material to the selected locations. The fusible material is preferably thermally responsive and may comprise ribbons or strips of extruded polyamide, nylon or polyester materials of the type manufactured by General Fabric Fusing Company of Cincinnati, Ohio. If desired, the fusible adhesive could be extruded directly onto pocket material 12. Adhesive areas 14 are of predetermined width and length, extending from upper end 16 to fold line 18 on material 12. Preferably, pocket blank 10 also includes a transverse adhesive area 20 positioned in spaced, parallel relationship near end 16 and across the reverse side of pocket blank 10. It will thus be apparent that adhesive areas 14 and 20 are formed by applying strips of fusible adhesive material to the same side of pocket material 12.

Figure 3:
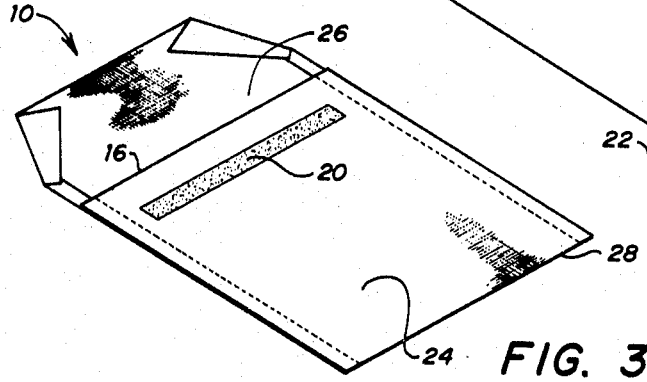
FIG. 3 is an illustration of the pocket blank shown in FIG. 2 after folding.

Two successive folding steps are then undertaken. The longitudinal edges of pocket blank 10 are first folded inwardly in the directions of arrows 22 in FIG. 2. After this folding step, adhesive areas 14 face the same direction as the obverse side, while adhesive area 20 remains oriented in the reverse direction. Thus, the edge portions of pocket blank 10 face in a direction opposite the original direction. After the folding of both longitudinal edges, pocket blank 10 is folded transversely along fold line 18. As is best shown in FIG. 3, pocket blank 10 now comprises inner panel 24 and outer panel 26 interconnected at one end by fold 28. It will thus be apparent that after the longitudinal and transverse folding operations, adhesive areas 14 extend continuously between end 16 and fold 28 within the adjacent, folded longitudinal edges of panels 24 and 26. Moreover, all raw edges are turned inwardly and are therefore concealed.

With the pocket blank 10 folded as shown in FIG. 3, activation of the fusible adhesive material between the adjacent longitudinal edges of panels 24 and 26 next occurs. Activation of the adhesive material is preferably accomplished by engaging heated means (not shown) with outer panels 26 of pocket blank 10. The means for activating the adhesive may comprise; for example, a heated press, ultrasonic or microwave means, or a radiant source capable of converting the adhesive from a solid to a plastic state. The temperature generated by and duration of engagement of the activating means are sufficient to melt the desired portions of adhesive areas 14, whereby the edges of pocket blank 10 are permeated with melted adhesive to become bonded together. It will be appreciated that use of a heated press for activating the fusible adhesive material to secure the edges of panels 24 and 26 would simultaneously function to press any wrinkles or folds in the edge portions. Furthermore, it will be understood that this means of adhesive connection is strong and durable as well as resistant to garment cleaning processes. Preferably, only a portion of each adhesive area 14 in the vicinity of fold 28 is initially activated. Thus, only the lower edge sections of folded pocket blank 10 are adhesively secured at first. This allows the upper section of outer panel 26 to be laid back exposing part of the pocket interior.

Figure 10:
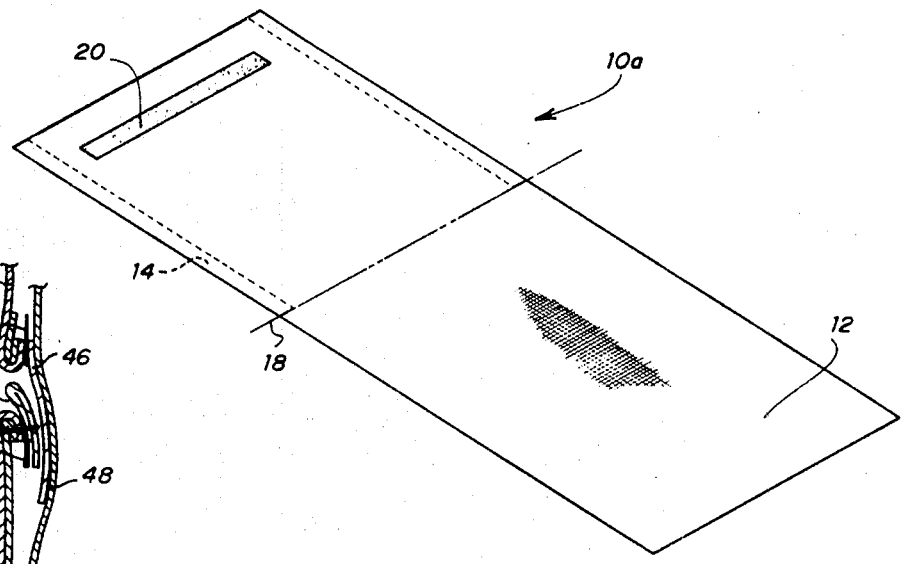
FIG. 10 is an illustration of an alternative to the pocket blank shown in FIG. 2.

Referring momentarily to FIG. 10, there is shown an alternate pocket blank 10*a* which could be substituted for pocket blank 10. Pocket blank 10*a* differs from pocket blank 10 primarily by virtue of the fact that adhesive areas 14 and 20 are located on opposite sides of the length of material 12, rather than on the same side. This eliminates the step of inwardly folding the longitudinal edges prior to the transverse folding operation. With pocket blank 10*a*, it is necessary only that material 12 be transversely folded along fold line 18 so that adheive areas 14 are inside the resultant panels 24 and 26. It will be appreciated that a relatively narrower length of material 12 can be formed into pocket blank 10*a*, which results in material savings and therefore cost savings. Pocket blank 10*a* might be used, for example, in an inexpensive garment since the exposed edges result in a less finished appearance. Raveling of the edges is prevented, however, by adhesive permeation of material 12 in areas 14 after activation.

While it is preferable that the steps of transversely folding the pocket blank 10 and then adhesively securing the lower edge sections thereof be carried out at this stage of the invention, it will be understood that these steps can occur later without departing from the spirit and scope of the invention. For instance, these steps could take place after the pocket blank 10 is attached to the garment, or after other subsequent steps.

Figure 4:
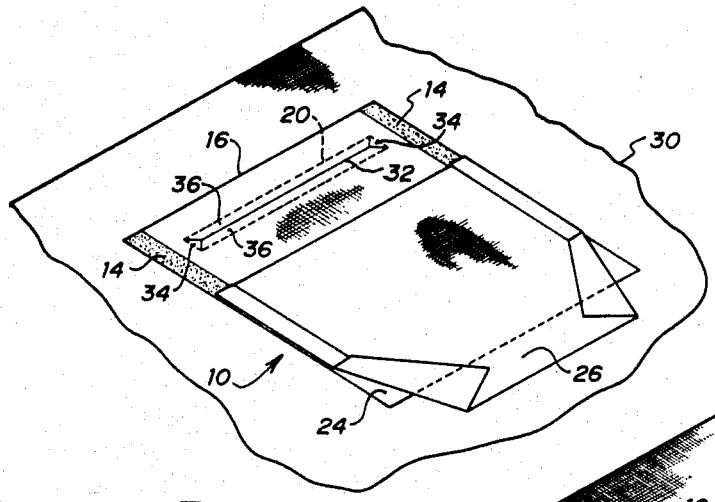
FIG. 4 is an illustration of the folded pocket blank positioned on the inside of a garment panel.

With a section of upper panel 26 laid back as shown in FIG. 4, the folded pocket blank 10 is then positioned on the inside surface of a garment 30 wherein the pocket is desired. The material of garment 30 can comprise any natural or synthetic cloth, the exact composition of which is not critical to the practice of the invention. In particular, the reverse side of panel 24 is placed downward with adhesive area 20 situated over the area in which the pocket slot will be formed. It will be recalled that the placement of adhesive area 20 on pocket blank 10 is preferred but not required in the practice of the invention. Alternatively, in the absence of adhesive area 20 on pocket blank 10, a corresponding adhesive area initially formed on garment 30 at the location of the pocket slot to be formed can be utilized, if desired. With the folded pocket blank 10 thus positioned, the fusible material of adhesive area 20 is activated to adhesively secure folded pocket blank 10 to garment 30.

Following the step of adhesively securing pocket blank 10 to garment 30, a transverse slit 32 is formed through garment 30, activated adhesive area 20 and inner panel 24. Slit 32 is thus made through the adhesive connection between pocket blank 10 and garment 30 so that the edges formed thereby are not unattached but are bonded together. The preferred configuration of slit 32 includes Y-shaped ends. This particular slit configuration is most important because two sets of opposing flaps, flap sets 34 and 36, are so formed.

Figure 5:
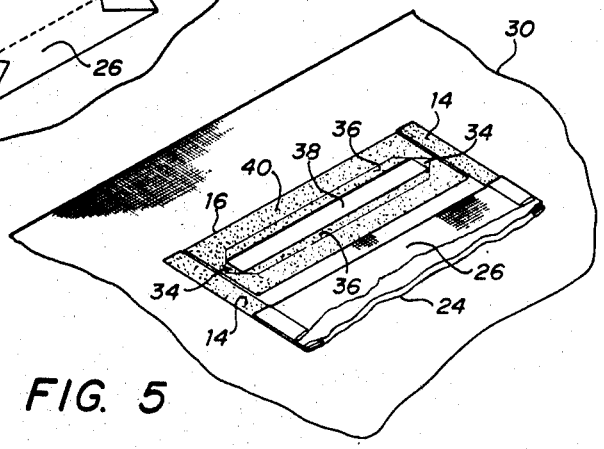
FIGS. 5, 6, and 7 are illustrations of successive steps in a method of constructing pockets in accordance with the invention.

Having made slits 32, the flap sets 34 and 36 are folded inwardly against the obverse side of inner panel 24 of pocket blank 10 as shown in FIG. 5. This exposes a rectangular opening through garment 30 and one panel of pocket blank 10 which will serve as pocket slot 38. Flap sets 34 and 36 must then be secured in their folded back positions.

The flap sets 34 and 36 are secured down with adhesive strip 40. In accordance with one construction, strip 40 comprises a rectangular piece of fusible adhesive including a cutout area corresponding to pocket slot 38. Adhesive strip 40 is laid over flap sets 34 and 36 in surrounding relationship with slot 38. It will be apparent that more than one separate adhesive strip can be positioned over flap sets 34 and 36 adjacent slot 38, if desired. It will be appreciated that adhesive strip 40, or its equivalent, could be extruded directly over flap sets 34 and 36, if desired. Adhesive strip 40 preferably consists of a piece of extruded adhesive material carried on one side of a backing layer (not shown). By this means, adhesive strip 40 is laid with the adhesive side downward. The fusible adhesive material of strip 40 can then be activated to secure flap sets 34 and 36 in place. Following activation of adhesive strip 40, the backing (not shown) can then be peeled away to expose the top side of the adhesive strip. At this point it will thus be apparent that adhesive areas surround pocket slot 38.

Figure 18:
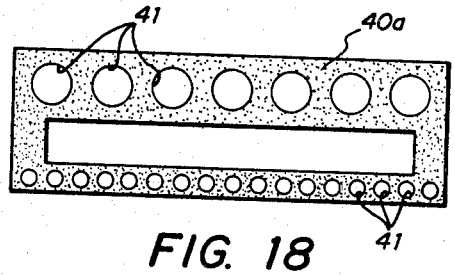
FIG. 18 is an illustration of an alternative to the adhesive strip shown in FIG. 5.

Referring momentarily to FIG. 18, there is shown an alternate adhesive strip **40*a* which can be substituted for adhesive strip 40. Adhesive strip 40*a* also includes a rectangular cutout area corresponding to pocket slot 38, and further includes a number of perforations 41 adjacent to the cutout area. The perforations 41 can be provided along one or both sides of the cutout in strip 40*a*. Thus, adhesive strip 40*a* essentially comprises a perforated adhesive strip 40. The advantage of using adhesive strip 40*a* is reduced stiffness surrounding pocket slot 38, which in turn improves the hand or feel of the garment 30. In some types of garments, such as lightweight or summer garments, for example, the use of adhesive strip 40 could cause considerable stiffening about the pocket slot, whereby the use of adhesive strip 40*a* would be highly desirable. Preferably, adhesive strip 40*a*** is formed of a piece of extruded fusible adhesive material carried on one side of a removable backing layer.

While adhesive strips 40 and **40*a* are illustrated as single piece constructions, it will be understood that individual adhesive strips can be positioned along the sides of pocket slot 38. For example, each adhesive strip 40 or 40*a*** can comprise four separate strips of adhesive, if desired.

To achieve a pocket construction of the desired type and finish, one or more pocket welts, a pocket flap, a facing strip, or combinations thereof are next attached. The materials of these pocket components may comprise any natural or synthetic cloth, the exact composition of which is not critical to the practice of the invention. If desired, any of these pocket components can comprise a material matching the garment 30. Depending upon the style or fashion, a welt could also be formed of a material contrasting with garment 30.

Figure 6:
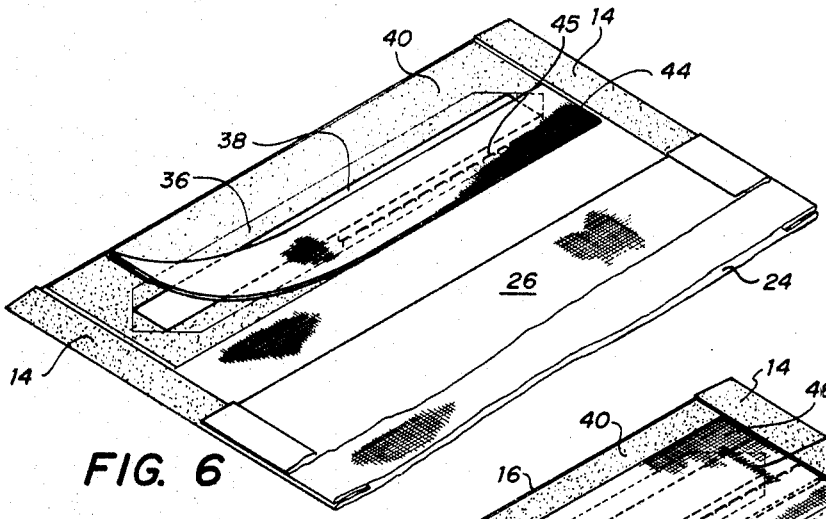

If desired, a welt 44 is first laid over the lower edge of pocket slot 38 and a portion of adhesive strip 40 as shown in FIG. 6. Welt 44 preferably comprises a relatively narrow piece of folded material with sufficient length to span panel 24 between adhesive areas 14. The folded edge of welt 44 is positioned across slot 38 to provide a finished appearance to the pocket opening. The fusible material comprising adhesive strip 40 is then activated to secure welt 44 to panel 24.

Figure 11:
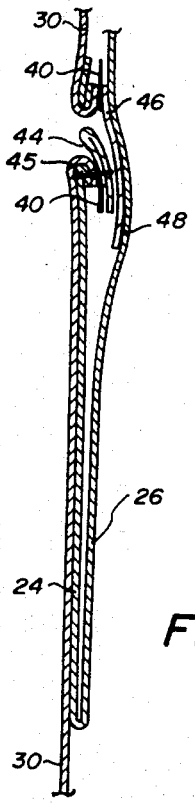
FIG. 11 is a sectional view taken generally along lines 11—11 in FIG. 9.

After placement of welt 44 over pocket slot 38, an optional switch 45 can be added for purposes of reinforcement. Stitch 45 extends adjacent to the lower edge of pocket slot 38 and interconnects welt 44, the lower half of flap set 36, and inner panel 24 of pocket blank 10. In adding stitch 45, the lower end of folded pocket blank 10 is preferably swung away from garment 30 so that the stitch does not pass through the outside surface of the garment. It will be understood that stitch 45 interconnects one layer of garment 30 to pocket blank 10 and welt 44 with no outside visible indication thereof on the garment. FIG. 11 best illustrates the location of stitch 45 in the preferred practice of the invention. Of course, if desired, stitch 45 can be provided completely through welt 44 and to the outside of the garment. Preferably, stitch 45 extends along substantially the entire width of pocket slot 38.

Figure 7:
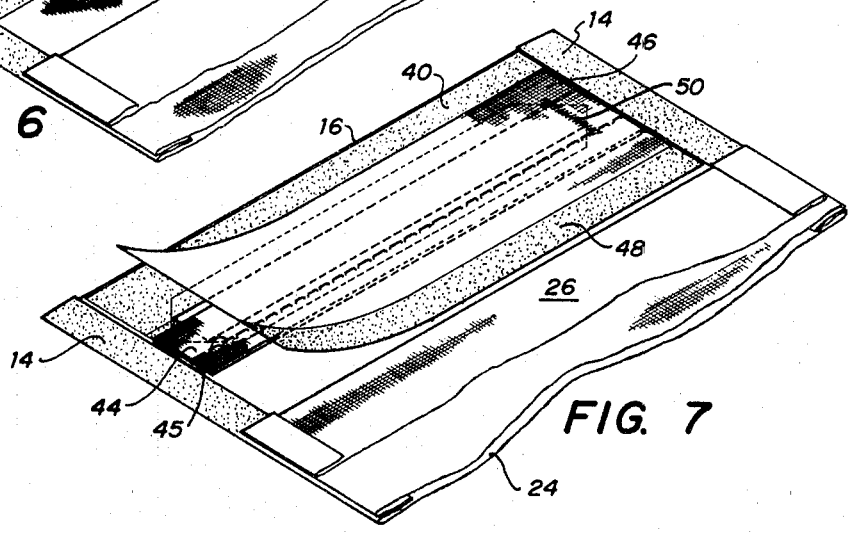
Figure 9:
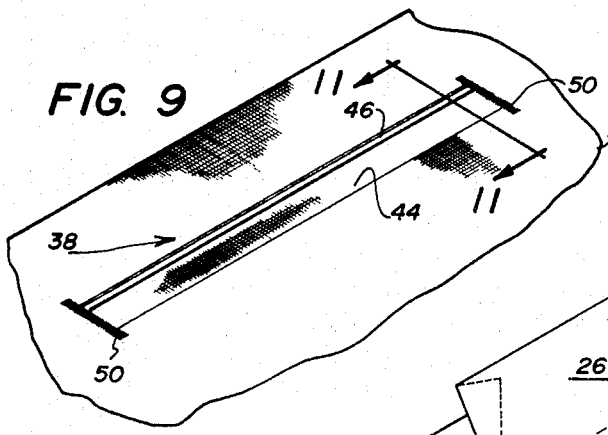
FIG. 9 is an illustration of the outside surface of a garment having a pocket formed in accordance with the invention.

If desired, a pocket facing strip can then be laid over welt 44 and the remaining portion of pocket slot 38 as shown in FIG. 7. Preferably, facing strip 46 is of sufficient width to cover welt 44 and pocket slot 38 without entirely covering the portion of adhesive strip 40 between slot 38 and end 16. Thus, the remaining exposed portion of adhesive strip 40 can be subsequently used to adhesively secure the ends of pocket panels 24 and 26. It will be apparent that a wider facing strip 46 covering the upper section of adhesive strip 40 could be utilized.

A wider facing strip 46 would preferably include an adhesive area (not shown) along the upper end of the outside surface thereof, by which outer pocket panel 26 would be adhesively secured to facing strip 46 which would be adhesively secured in turn to inner pocket panel 24. As shown in FIG. 7, facing strip 46 preferably includes adhesive area 48 along the lower end of the outside surface thereof. Adhesive area 48 comprises a layer of fusible adhesive material which will be utilized subsequently to secure outer pocket panel 26 to strip 46.

It will be appreciated that the pocket construction can include a facing strip 46 without welt 44. In the event a facing strip 46 alone is desired, a strip of material (not shown) should first be placed between the lower sections of facing strip 46 and adhesive strip 40 to act as a buffer. Such a buffer strip (not shown) would be required to prevent facing strip 46 from becoming adhesively secured in surrounding relationship with pocket slot 38. Access to the interior of the pocket construction would therefore be maintained.

After positioning of pocket welt 44 and/or pocket facing strip 46, stitched bar tacks 50 are added at each end of pocket slot 38. Tacks 50, only one of which is shown in FIG. 7, serve to mechanically interconnect garment 30, inner pocket panel 24, and the desired pocket components. Tacks 50 also help secure flap set 34 in a folded inward configuration. Thus, tacks 50 function to reinforce the pocket construction, and further serve to lend a handmade appearance to the outside of garment 30. As shown, tacks 50 mechanically interconnect garment 30, panel 24, welt 44, and facing strip 46.

Although stitched bar tacks 50 lend a more handmade appearance to the outside of garment 30, it will be apparent that other means of connection can be used equally as well. For example, staples or rivets can be substituted for tacks 50. If desired, suitable adhesive could also be used in place of stitched bar tacks 50.

Figure 8:
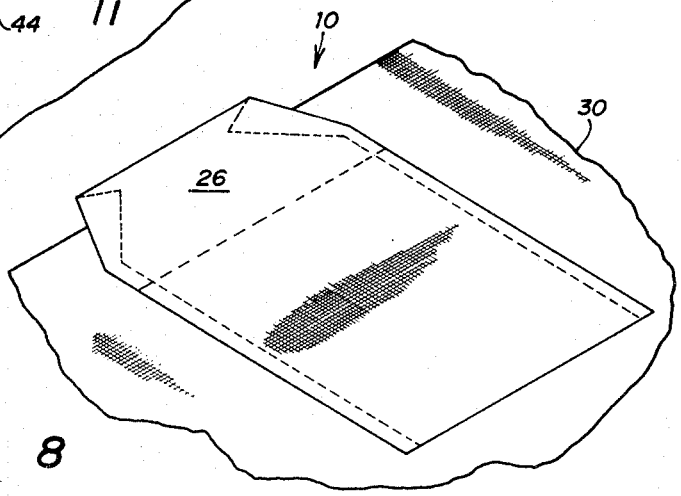
FIG. 8 is an illustration of the inside surface of a garment having a pocket formed in accordance with the invention.

Subsequent to the placement of tacks 50, the interior assembly of the pocket can be inspected before closing panel 26 and activating the remaining adhesive areas to seal the upper section of the folded pocket blank 10. With panel 26 closed as shown in FIG. 8, activation of adhesive area 48, the remaining portions of adhesive areas 14 and adhesive strip 40 completes the pocket construction. A cross section of a finished, single welt pocket constructed in accordance with the invention is shown in FIG. 11. The pocket shown in FIG. 11 includes optional stitch 45.

Figure 12:
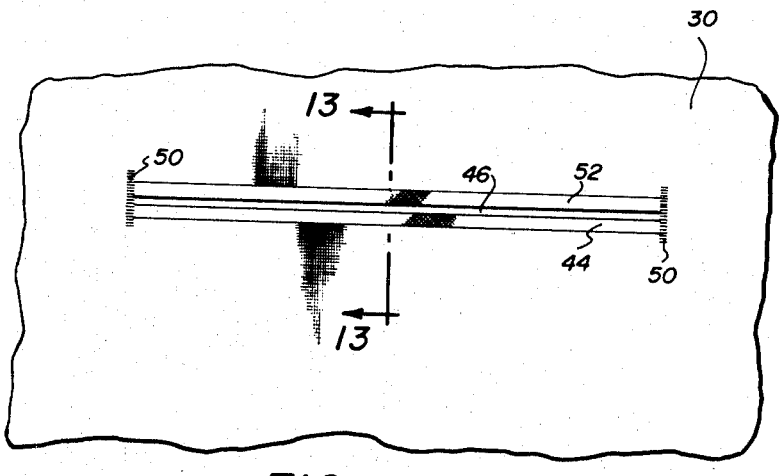
FIG. 12 is an illustration of the outside surface of a garment having a pocket formed in accordance with a first modification of the invention.
Figure 13:
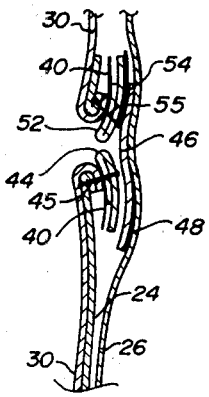
FIG. 13 is a partial sectional view taken generally along lines 13—13 in FIG. 12.

Turning now to FIGS. 12 and 13, the step of attaching a second pocket welt 52 as shown can be included in the invention. In particular, second welt 52 is laid over adhesive strip 40 so as to extend across the upper edge of pocket slot 38. This step can be carried out either before or after the placement of first welt 44, but prior to the placement of facing strip 46. The fusible material comprising adhesive strip 40 is then activated to secure second welt 52 across pocket slot 38 to panel 24. If desired, pocket facing strip 46 can then be laid over welts 44 and 52, and the remaining portion of pocket slot 38. Depending upon the width of second welt 52, it may be necessary to first position adhesive strip 54 between welt 52 and facing strip 46 to provide for later sealing of the upper pocket construction. It will be apparent that the purpose of adhesive strip 54 could also be served by the initial provision of adhesive areas (not shown) at the appropriate locations on either second welt 52 or facing strip 46, if desired. As is best shown in FIG. 13, it will be appreciated that either adhesive strip 40 or adhesive strip 54 can be provided with sufficient width to secure the upper end of pocket panel 26 to inner panel 24 and/or the inside of garment 30. An optional stitch 55 can be added for reinforcement. Stitch 55 is similar to optional stitch 45, but is utilized to interconnect second welt 52, the upper half of flap set 36, and inner panel 24. Stitch 55 preferably extends along substantially the entire width of pocket slot 38. After positioning of welts 44 and 52, and facing strip 46, stitched bar tacks 50 are added to mechanically interconnect the desired components, inner panel 24 and garment 30. Panel 26 is then closed and sealed in the usual manner to complete the pocket construction. Consequently, it will be understood that the method of the invention can be utilized to construct pockets having double welts.

Figure 14:
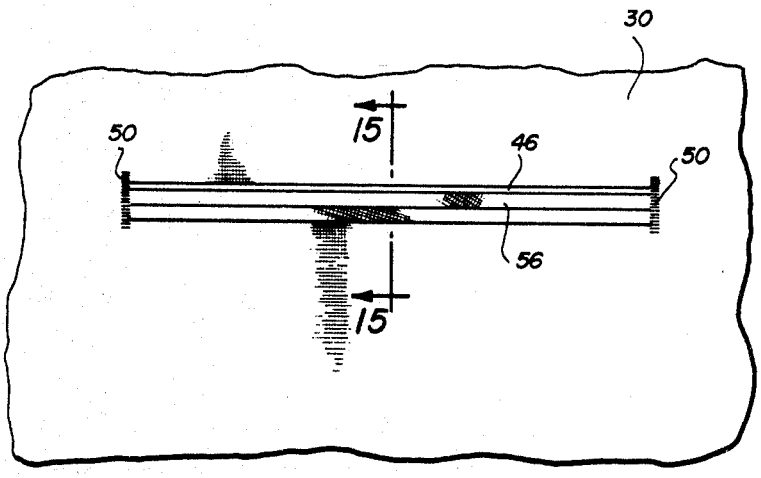
FIG. 14 is an illustration of the outside surface of a garment having a pocket formed in accordance with a second modification of the invention.
Figure 15:
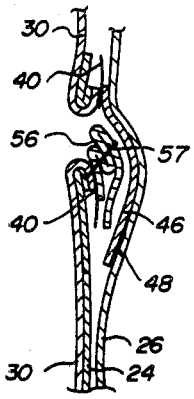
FIG. 15 is a partial sectional view taken generally along lines 15—15 in FIG. 14.

Referring to FIGS. 14 and 15, there is shown a simulated double welt 56 which can be incorporated into the invention. In place of single welt 44, welt 56 cain be laid over adhesive strip 40 across the lower edge of pocket slot 38. Simulated double welt 56 comprises a length of suitable material folded so as to give the appearance of a double welt construction. As is best shown in FIG. 15, simulated double welt 56 achieves this purpose by being folded and flattened in an uneven W configuration. No additional adhesive strips are required when using welt 56. After the positioning of simulated double welt 56, the fusible material comprising adhesive strip 40 is then activated to secure welt 56 to panel 24 across pocket slot 38. An optional stitch 57 can be added for reinforcement. Stitch 57 is similar to stitch 45, and is utilized to interconnect double welt 56, the lower half of flap set 36, and inner panel 24. Stitch 57 preferably extends along substantially the entire width of pocket slot 38.

If desired, pocket facing strip 46 can then be laid over welt 56 and the remaining portion of pocket slot 38, followed by the placement of stitched bar tacks 50. Panel 26 can then be closed and sealed in the usual manner. Consequently, it will be understood that the method of the invention can be utilized to construct a simulated double welt pocket.

Figure 16:
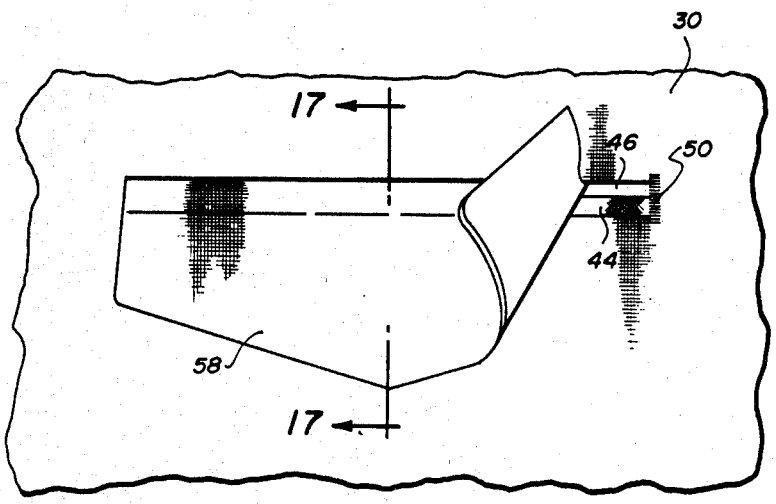
FIG. 16 is an illustration of the outside surface of a garment having a pocket formed in accordance with a third modification of the invention.
Figure 17:
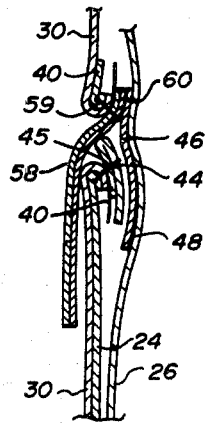
FIG. 17 is a partial sectional view taken generally along lines 17—17 in FIG. 16.

With reference now to FIGS. 16 and 17, placement of pocket flap 58 can be incorporated in the method of the invention. The width of flap 58 is such that it can be positioned within pocket slot 38. Flap 58 can be utilized with or without welt 44 and/or facing strip 46. Preferably, flap 58 is utilized in conjunction with welt 44 and facing strip 46. Either before or after the placement of welt 44, flap 58 is positioned within the pocket slot 38 so that the upper end of flap 58 overlays adhesive strip 40 adjacent the upper side of slot 38. The fusible material comprising adhesive strip 40 is activated to secure flap 58 to panel 24. An optional stitch 59 can be added for reinforcement. Stitch 59 is similar to stitch 45, but is utilized to interconnect flap 58, the upper half of flap set 36, and inner panel 24. Stitch 59 preferably extends along substantially the entire width of pocket slot 38. If desired, facing strip 46 can then be laid over the upper end of flap 58, welt 44, and over the remaining portion of pocket slot 38. Adhesive strip 60 is positioned between the upper end of flap 58 and facing strip 46 to provide a means for sealing the upper end of the pocket construction. It will be appreciated that adhesive areas (not shown) can be provided initially at the appropriate locations on flap 58 and/or facing strip 46 to function in place of adhesive strip 60, if desired. Stitched bar tacks 50 are then added at each end of slot 38 to mechanically interconnect garment 30, panel 24, and the desired pocket components. It will be understood that tacks 50 do not extend through flap 58. Following formation of tacks 50, panel 26 is closed and the remaining adhesive areas are secured to seal the upper section of the pocket construction. Consequently, it will be understood that the method of the invention can also be utilized to construct pockets having flaps.

Figure 19:
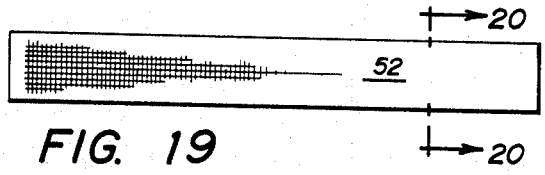
FIG. 19 is an illustration of an alternative to the welt shown in FIGS. 6 and 7.
Figure 20:
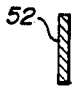
FIG. 20 is a sectional view taken generally along lines 20—20 in FIG. 19.
Figure 21:
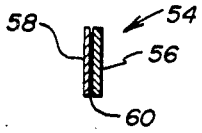
FIG. 21 is a sectional view of another alternate welt.

Referring now to FIGS. 19–21, there are illustrated two alternate welt constructions. FIGS. 19 and 20 show welt 52 which comprises a single layer of unfolded material. Welt 52 therefore does not have a rolled upper edge as does welt 44 hereinbefore described. Preferably, welt 52 is formed by ultrasonically trimming a welt blank (not shown) of suitable material, such as polyester blend fabric, so that the edges of the welt are fused and are therefore resistant to raveling. If desired, a layered welt construction can be employed. FIG. 21 shows welt 54 comprising fabric 56 bonded to a layer of backing 58 with adhesive 60. In place of backing 58, a layer of fusing could be applied to one side of welt 54 without adhesive 60 to form the layered welt construction. It will be understood that welt 52 or welt 54 can be used instead of rolled welt 44 in the practice of the present invention. For example, welts 52 and 54 may be used in less expensive garments which do not require the more finished appearance of welt 44.

Figure 22:
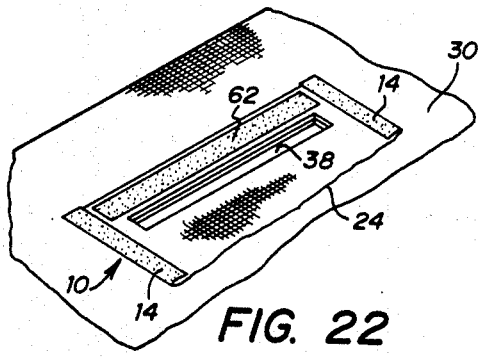
FIG. 22 is an illustration of an alternate approach to the pocket slot formation step.

In reference to FIG. 22, there is shown one alternate approach to the formation of pocket slot 38 in the practice of the invention. Instead of first forming a slit of predetermined configuration through inner pocket panel 24 and garment 30, a rectangular opening defining slot 38 can be formed directly. Pocket slot 38 can be formed with an ultrasonic beam, laser beam, hot knife or rectangular die punch. According to the preferred construction, pocket slot 38 is cut or punched out through adhesive area 20 so that the edges of panel 24 and garment 30 forming the boundary of the slot are bonded together. It will thus be apparent that direct formation of rectangular pocket slot 38 eliminates the step of backwardly folding the flaps resulting from a slit configuration such as slit 32 shown in FIG. 4. There being no flap sets to secure down, it would not be necessary to surround slot 38 with adhesive, such as adhesive strip 40, except when a single welt will be provided along the lower edge of the pocket slot. When forming pocket slot 38 directly an adhesive strip such as adhesive strip 62 is positioned adjacent to the top edge of pocket slot 38 at least for subsequent activation to seal the upper section of folded pocket blank 10.

Figure 23:
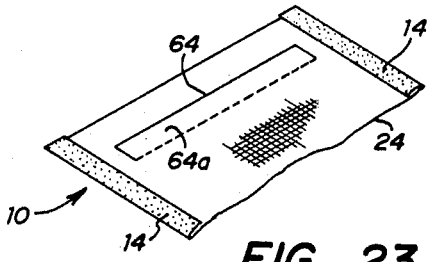
FIGS. 23-26 are illustrations of two other alternate approaches to the pocket slot formation step.
Figure 24:
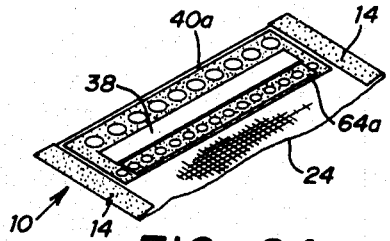
Figure 25:
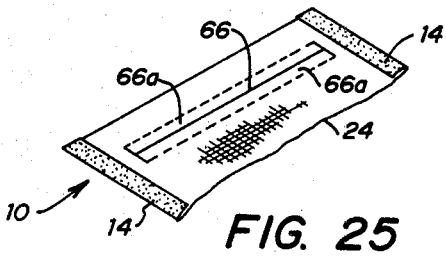
Figure 26:
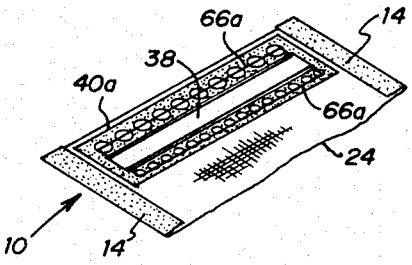

Referring now to FIGS. 23–26, there are shown two other alternate approaches to the formation of pocket slot 38 in the practice of the invention. Instead of a slit having Y-shaped ends, such as slit 32 shown in FIG. 4, other predetermined slit configurations can also be utilized. FIG. 23 illustrates slit 64 comprised of L-shaped ends, while FIG. 25 depicts slit 66 having ends of T-shaped configuration. Slits 64 and 66 are formed through the adhesive connection between garment 30 and the inner panel 24 of pocket blank 10. The use of slit 64 results in one pocket slot flap **64*a*. The use of slit 66 results in one set of pocket slot flaps 66*a*. Having made slit 64 or 66, flap 64*a* or flap set 66*a*, respectively, is next folded backward against the obverse side of inner pocket panel 24 to create pocket slot 38. Flap 64*a* or flap set 66*a* is then secured in a folded down position as shown in FIGS. 24 and 26, respectively, by means of a strip of adhesive such as adhesive strip 40 or 40*a*. In all other respects, the method of constructing pockets proceeds as hereinbefore described when slits 64 or 66** are employed.

Figure 27:
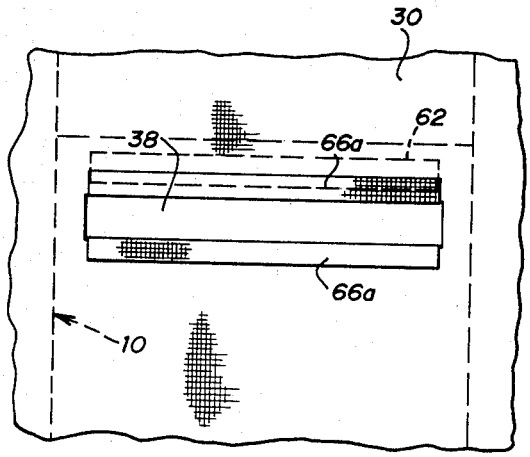
FIG. 27 is an illustration of the outside surface of a garment having the pocket slot flaps folded outwardly.

Referring to FIG. 27, there is shown a garment 30 having flap set **66*a* folded backwardly and secured to the outside surface of the garment. In some cases, it is not necessary to fold a pocket slot set inwardly and secure it to inner pocket panel 24. For example, in a disposable garment where appearance and finish are less important than low production cost, the pocket slot flap sets can be folded outwardly and secured to the outside surface of the garment. For purposes of illustration, FIG. 27 shows the flaps resulting from a slit, such as slit 66 in FIG. 25, folded backward and secured to the outside of garment 30. However, it will be apparent that other slit configurations, such as slits 32 and 64 of FIGS. 4 and 23, respectively, could be employed in the same manner. Preferably, flap set 66*a* is adhesively secured to garment 30 using fusible adhesive material and techniques hereinbefore described. An adhesive strip similar to adhesive strip 62 is preferably provided at least above pocket slot 38 on the obverse side of pocket panel 24 to secure the upper section of pocket blank 10. Instead of strip 62, of course, an adhesive strip similar to strip 40 or 40*a*** would be used in adding a welt to such a pocket construction. In all other respects, the method of constructing pockets proceeds as described hereinabove.

From the foregoing, it will be understood that the present invention comprises a method of constructing pockets which incorporates numerous advantages over the prior art. One important advantage deriving from the method of the invention involves the fact that numerous manual operations which were heretofore required in the construction of pockets have been eliminated. Other important benefits derive from the extensive use of fusible materials in the construction process. A further advantage is the fact that all steps of the method, including the steps of adhesively securing sections of the pocket by activation of fusible materials, are performed from the inside of the garment so that the outside surface of the garment is protected from damage. Other advantages deriving from the use of the invention will readily suggest themselves to those skilled in the art.

Although particular embodiments of the invention have been illustrated in the accompanying Drawings and described in the foregoing Detail Description, it will be understood that the application not limited to the embodiments disclosed, but is intended to embrace any alternatives, modifications, rearrangements and substitutions of parts and elements as fall within the spirit and scope of the invention.

What is claimed is:

1. In a method of constructing pockets in garment panels wherein a length of pocket material having reverse and obverse sides is connected to the garment panel, folded transversely to form inner and outer pocket panels, and secured at adjacent edges and ends of the folded length of pocket material; the improvement comprising the steps of:

positioning the reverse side of the length of pocket material on the inside surface of the garment panel wherein a pocket is to be formed;

adhesively securing the length of pocket material to the garment panel; and physically separating and removing a predetermined discrete area of the length of pocket material and the adjacent portion of the garment panel and thereby forming a pocket slot of predetermined length and width directly through the garment panel and length of pocket material with the adhesive connection therebetween.

2. The improvement according to claim 1 wherein the length of pocket material includes a transverse strip of fusible adhesive material attached on the reverse side in spaced relation to one end of the length of pocket material, and wherein the step of adhesively securing said length of pocket material to said garment panel is accomplished by activating said adhesive strip.

3. The improvement according to claim 1 wherein the step of forming the pocket slot through the garment panel and length of pocket material is accomplished by punching out a rectangular section corresponding to the pocket slot.

4. The improvement according to claim 1 wherein the step of forming the pocket slot directly through the garment panel and length of pocket material is accomplished by cutting out a rectangular section corresponding to the pocket slot.

5. The pocket constructed according to the improved method of claim 1.

6. A method of constructing pockets in garments, comprising the steps of:

providing a length of pocket material having reverse and obverse sides;

positioning the reverse side of the length of pocket material on the inside surface of a garment panel wherein a pocket is to be formed;

physically separating and removing a predetermined discrete area of the length of pocket material and the adjacent portion of the garment panel and thereby forming a pocket slot directly through the adhesively secured area joining the garment panel and the length of pocket material;

transversely folding the length of pocket material a predetermined distance from one end thereof to form inner and outer opposed, parallel pocket panels interconnected by a fold with the obverse sides thereof facing inwardly;

interconnecting the inner pocket panel and the garment panel adjacent to the pocket slot; and securing the ends of the folded length of pocket material and the adjacent edges of the inner and outer pocket panels to complete construction of the pocket.

7. The method of claim 6 wherein the length of pocket material includes a strip of fusible adhesive material attached across the reverse side in spaced relationship with one end of the length of pocket material, and wherein the step of securing the length of pocket material to the garment panel is accomplished by activating said adhesive strip to adhesively secure the length of pocket material to the garment panel.

8. The method of claim 6 wherein the garment panel includes a strip of fusible adhesive material attached on the inside surface in the area where a pocket slot is to be formed, and wherein the step of securing the length of pocket material to the garment panel is accomplished by activating said adhesive strip to adhesively connect the length of pocket material to the garment panel.

9. The method of claim 6 wherein the length of pocket material includes strips of fusible adhesive material attached to the obverse side along both longitudinal edges thereof, and wherein the step of securing the adjacent edges of the transversely folded length of pocket material is accomplished by activating said adhesive strips to adhesively connect the edges of the pocket panels.

10. The method of claim 6 wherein the length of pocket material includes strips of fusible adhesive material attached to the reverse side along both longitudinal edges thereof, and further including the step of:

inwardly folding the longitudinal edges of the length of pocket material so that the reverse sides of the longitudinal edge portions face in the obverse direction; and wherein the step of securing the adjacent edges of the transversely folded length of pocket material is accomplished by activating said adhesive strips to adhesively connect the folded edges of the pocket panels.

11. The method of claim 6 wherein the step of securing the ends of the transversely folded length of pocket material comprises the steps of:

providing a strip of fusible adhesive material on the obverse side of the length of pocket material above the pocket slot; and subsequently activating said adhesive strip to adhesively secure the ends of the transversely folded length of pocket material.

12. The method of claim 6 including the steps of:

positioning a pocket welt to extend across the pocket slot; and securing the pocket slot to the obverse side of the length of pocket material along the lower edge of the pocket slot.

13. The method of claim 6 including the steps of:

positioning a pocket flap within the pocket slot so that the lower end of the flap extends therethrough; and securing the upper end of the flap to the obverse side of the inner pocket panel above the pocket slot.

14. The method of claim 6, including the steps of:

positioning a pocket facing strip over the pocket slot;

securing the upper end of the facing strip to the obverse side of the inner pocket panel above the pocket slot; and securing the lower end of the facing strip to the obverse side of the outer pocket panel.

15. The pocket constructed according to the method of claim 6.

16. A method of constructing pockets in garments, comprising the steps of:

providing a length of pocket material having reverse and obverse sides;

positioning the reverse side of the length of pocket material on the inside surface of a garment panel wherein a pocket is to be formed;

adhesively securing the length of pocket material to said garment panel;

forming a slit in the adhesively secured area through the garment panel and the length of pocket material;

folding the secured edges of the garment panel and the pocket material surrounding the slit backward against the outside surface of the garment panel;

securing the backwardly folded edges of the garment panel and the pocket material to the garment panel to form a pocket slot;

transversely folding the length of pocket material a predetermined distance from one end thereof to form inner and outer opposed, parallel pocket panels interconnected by a fold with the obverse sides thereof facing inwardly; and securing the ends of the folded length of pocket material and the adjacent edges of the inner and outer pocket panels to complete construction of the pocket.

17. The method of claim 16, including the step of:

interconnecting at least one panel of the length of pocket material to the garment panel adjacent at least one side of the pocket slot.

18. The method of claim 16, including the step of:

interconnecting the garment panel and at least one panel of the length of pocket material adjacent to the bottom edge of the pocket slot.

19. The method of claim 16, wherein the length of pocket material includes a strip of fusible adhesive material attached across the reverse side in spaced relationship with one end of the length of pocket material, and wherein the step of securing the length of pocket material to the garment panel is accomplished by activating said adhesive strip to adhesively secure the length of pocket material to the garment panel.

20. The method of claim 16, including the steps of:

providing a strip of fusible adhesive material above the pocket slot on the obverse side of the length of pocket material; and subsequently activating said adhesive strip to adhesively secure the ends of the length of pocket material.

21. The pocket constructed according to the method of claim 16.

22. A pocket construction for a garment, which comprises:

a length of pocket material having reverse and obverse sides;

means for adhesively securing a region in spaced relationship with one end of the reverse side of the pocket material to the inside surface of the garment panel wherein a pocket is to be constructed;

said adhesively secured region including a pocket slot formed therein through physical separation and removal of a predetermined discrete area of the length of pocket material and the adjacent portion of the garment panel and the pocket material;

said length of pocket material being folded transversely to form inner and outer opposed, parallel pocket panels interconnected at the lower end by a fold;

means positioned adjacent to the pocket slot for interconnecting the garment panel and at least the inner pocket panel; and means for securing the ends and the edges of the pocket panels to complete construction of the pocket.

23. The pocket construction of claim 22 wherein the longitudinal edges of the length of pocket material are folded inside the inner and outer pocket panels before being secured.

24. The pocket construction of claim 22 including:

a pocket welt positioned across the inside of the pocket slot; and means for securing the welt to the inner pocket panel along the lower edge of the pocket slot.

25. The pocket construction of claim 22 including:

a pocket facing strip positioned over the inside of the pocket slot; and means for securing the lower end of the facing strip to the outer pocket panel and the upper end of the facing strip to the inner pocket panel.

26. The pocket construction of claim 22 including:

a pocket flap positioned within the pocket slot with the lower end of the flap extending therethrough; and means for securing the upper end of the flap to the inner pocket panel.

27. The improvement according to claim 1, wherein the length of pocket material is adhered to the garment panel by use of an adhesive strip with a rectangular cutout area corresponding to the desired dimension of the pocket slot and a number of perforations adjacent to the cutout area such that the stiffness is reduced in the adhesively attached material surrounding the pocket slot.

28. The method of claim 6, wherein the length of pocket material is adhered to the garment panel by use of an adhesive strip with a rectangular cutout area corresponding to the desired dimensions of the pocket slot and a number of perforations adjacent the cutout area such that the stiffness is reduced in the adhesively attached material surrounding the pocket slot.

29. The method of claim 16, wherein the length of pocket material is adhered to the garment panel by use of an adhesive strip with a rectangular cutout area corresponding to the desired dimensions of the pocket slot and a number of perforations adjacent the cutout area such that the stiffness is reduced in the adhesively attached material surrounding the pocket slot.

30. The pocket construction of claim 22, wherein the means for securing a region in spaced relationship with one end of the reverse side of the pocket material to the inside surface of the garment panel is an adhesive strip with a rectangular cutout area corresponding to the desired dimension of the pocket slot and a number of perforations adjacent the cutout area such that the stiffness is reduced in the adhesively attached material surrounding the pocket slot.

31. For use in joining a length of pocket material to a garment panel and thereafter facilitating the forming of a pocket slot having a predetermined length and a predetermined width through the length of pocket material and the adjacent portion of the garment panel, the improvement comprising:

a planar body of fusible adhesive material;

a rectangular aperture formed through the planar body of fusible adhesive material and having a length and a width corresponding to the predetermined length and width of the pocket slot;

the planar body of fusible adhesive material surrounding the entire periphery of the rectangular aperture so that upon actuation of the fusible adhesive material the length of pocket material is adhesively secured to the garment panel around the entire periphery of the pocket slot;

the planar body of adhesive material further having a plurality of apertures formed therethrough positioned along lines extending adjacent opposite sides of the rectangular aperture.

* * * * *